United States Patent [19]

Stengard

[11] 4,274,210

[45] Jun. 23, 1981

[54] GAS NOZZLE FOR USE IN TREATING MATERIAL WEBS

[75] Inventor: Charles Stengard, Turku, Finland

[73] Assignee: Valmet Oy, Finland

[21] Appl. No.: 74,558

[22] Filed: Sep. 11, 1979

[30] Foreign Application Priority Data

Sep. 11, 1978 [FI] Finland ..... 782774

[51] Int. Cl.[3] ..... F26B 13/20

[52] U.S. Cl. ..... 34/156; 226/97; 239/DIG. 7; 239/558

[58] Field of Search ..... 34/155, 156; 239/DIG. 7, 590, 558, 518; 226/97

[56] References Cited

U.S. PATENT DOCUMENTS

| | | | |
|---|---|---|---|
| 3,181,250 | 5/1965 | Vits | 34/156 |
| 3,199,224 | 8/1965 | Brown | 34/155 |
| 3,462,085 | 8/1969 | Nugarus | 239/590 |
| 3,861,062 | 1/1975 | Wymann | 34/155 |
| 3,936,953 | 2/1976 | Chance et al. | 34/156 |
| 3,995,375 | 12/1976 | Weinmann | 34/155 |
| 4,137,644 | 2/1979 | Karlsson | 34/156 |

FOREIGN PATENT DOCUMENTS

| | | | |
|---|---|---|---|
| 154674 | 5/1951 | Australia | 239/DIG. 7 |

*Primary Examiner*—Larry I. Schwartz
*Attorney, Agent, or Firm*—Steinberg & Raskin

[57] ABSTRACT

A nozzle for use in web treatment apparatus includes a carrying surface extending substantially parallel to the web and guide members defining an annular slit in a central region of the carrying surface, the guide members being formed such that gaseous medium flows radially through the slit in contiguity with the carrying surface and in a direction substantially parallel to the web.

10 Claims, 7 Drawing Figures

GAS NOZZLE FOR USE IN TREATING MATERIAL WEBS

BACKGROUND OF THE INVENTION

The present invention concerns a nozzle for treating web-like materials and by which air, or another equivalent gaseous fluid is blown into contiguity but without contact with the material web that is to be supported and possibly at the same time to be otherwise treated, such, for example, as dried said nozzle having a substantially annular nozzle slit and a carrying surface producing said supporting effect.

Various types of air nozzles are employed to blow in gas in apparatus used on paper manufacturing and conversion machines for contact-free cleaning, drying and stabilizing of the web. The gas blown by the aid of said nozzles is conducted onto one or both sides of the web, whereafter the gas is drawn off to be reused before the next nozzle.

The said nozzles of in the prior art may be divided into two groups: overpressure nozzles and subatmospheric pressure nozzles. The operation of the former is based on the so-called air cushion principle, whereby the air jet causes a static over-pressure in the space between the nozzle and the web.

The subatmospheric nozzles include the so-called airfoil nozzles, which attract the web and stabilize its course. The attraction exerted on the web results, as is well known from the presence of a gas flow field parallelling the web and which as a result of its flow state gives rise to a static subatmospheric pressure between the web and the supporting surface of the nozzle, the so-called carrying surface. In overpressure as well as subatmospheric pressure nozzles the so-called Coanda phenomenon is often applied in order to direct the air in desired direction.

The overpressure nozzles of the prior art direct sharp air jets against the web. Such a local air jet greatly enhances the heat transfer at the localized areas where the air jet and the web meet, thus giving rise to unequal heat transfer coefficient distribution in the longitudinal direction of the web, and this fact may inflict quality damage on the web that is being treated. Another drawback in the use of overpressure nozzles is that owing to the over-pressure feature they cannot be applied in one-sided treatment of the web.

Regarding the patent literature associated with the present invention, reference is made to the following: U.S. Pat. No. 3,587,177, German publicizing print No. 2.020.430, and Finnish Patent No. 42 522.

It is a characteristic feature in the design of the nozzles disclosed in U.S. Pat. No. 3,587,177 and in the German publicizing print No. 2.020.430 that the nozzle slit opening onto the entrance edge of the nozzles' carrying surface is extended onto a curved flow guiding surface connecting with the front edge of the carrying surface so that the flow can be made to follow the carrying surface. The drawback of these prior art nozzles of prior art is that the gas flow parallel to the web tends to eject drying gas from the preceding suction space that has already cooled, thereby lowering the differential temperature between web and drying gas and thus impairing the heat transfer capacity. In these nozzles the distance of the web from the carrying surface is quite small (2–3 mm), which imposes high dimensional requirements on straightness and smoothness of the drying surface (the carrying surface) composed of nozzles.

This introduces structurally strict requirements in the manufacturing of great breadth (over 3 m) nozzles spanning the whole web.

Through the Finnish Patent No. 42 522 already cited, a nozzle is known wherein the air is blown on one side of the web in the form of jets substantially parallelling it and which cause in the breadth direction of the web, discontinuities, as a result of which the heat transfer capacity is non-uniform. For the same reason the stability of the web is not good, and this nozzle cannot be used to handle thin webs, owing to the flutter which is then encountered. It is also impossible to use high blowing rates in this nozzle, and it is not usable for two-sided web treatment.

Reference is further made to the same applicant's earlier Finnish patent application No. 781375, the air-dryer nozzle therein disclosed being characterized in that the nozzle slit is located in the gas flow direction before the plane of the curved guiding surface's entry edge and that the ratio of the nozzle slit width and the radius of curvature of said guiding surface has been so selected with the gas flow velocities encountered, that the gas flow will detach from the curved guiding surface substantially before its trailing edge. The circumstances which were realized in the said Finnish patent application may be applied in connection with the present invention as well, in applicable parts.

The modern, high output paper manufacturing and conversion machines and equipment which utilizes the type of nozzles described immediately above are bulky, space-consuming and expensive. Owing to the poor stabilizing capacity of nozzles known in the prior art, it has previously been impossible to give one-sided treatment to heavy material webs other than in the horizontal plane and with blowing from the underside of the web. This circumstance has contributed to restricting the design freedom of the drying section and to increasing the size of the machine and of the building housing it.

SUMMARY OF THE INVENTION

The object of the present invention is to avoid the drawbacks mentioned and to create an air nozzle based on the subatmospheric pressure principle by the use of which the evaporating and stabilizing capacity of the dryer can be substantially improved.

It is further an object of the invention to provide a nozzle of the type mentioned which has a specific energy consumption which is considerably lower than any nozzle of prior art.

In order to attain the aims stated, the invention is mainly characterized in that the annular nozzle slit is encircled or surrounded by the carrying surface, into contiguity with which the supporting fluid exiting mainly from the nozzle is conducted to become a substantially radially outwardly directed flow field.

The significant increase in the specific evaporating capacity of the nozzle possessing the characteristics just defined is mainly due to the higher heat transfer coefficient between the web and the drying gas obtained thereby. Three factors may be mentioned which combine to improve the heat transfer coefficient. The first factor is the circumstance that as a result of the radial flow field of the nozzle of the invention a smaller spacing of the web from the carrying surface is obtained than was previously possible. The second factor is that owing to the radial flow provided by the nozzle of the invention its flow cross section is variable of its configuration, the turbulence resulting therefrom improving the heat transfer coefficient. The third factor responsible for a better heat transfer coefficient is that in the use of the nozzle of the invention, owing to the opposed directions of gas flow, there will be no ejection of air into the next nozzle.

The reduction in specific energy consumption in the case of the nozzle of the invention, compared with equivalent nozzles of the prior art, is partly due to the lower specific resistance and, partly, to the fact that in association with the nozzle of the invention no guide members are needed thereby eliminating the detrimental pressure drops necessarily caused thereby.

The improved stabilizing capacity of the nozzle of the invention, compared with nozzles of the prior art, is partly a result of the avoidance of ejection air entrained from the area of an adjacent nozzle and partly due to the fact that the radial flow field binds the web symmetrically in all directions.

According to a favourable embodiment of the invention, the web distance and binding capacity can be substantially influenced by blowing into the centre of the nozzle's annular slit a small quantity of air straight towards the web, whereby the distance between the carrying surface and the web increases and the binding capacity becomes weaker.

DESCRIPTION OF THE DRAWINGS

In the following, the invention is described in detail with reference to some embodiment examples of the invention, presented in the figures of the attached drawing, but to the details of which the invention is in no way confined.

Figure 1:
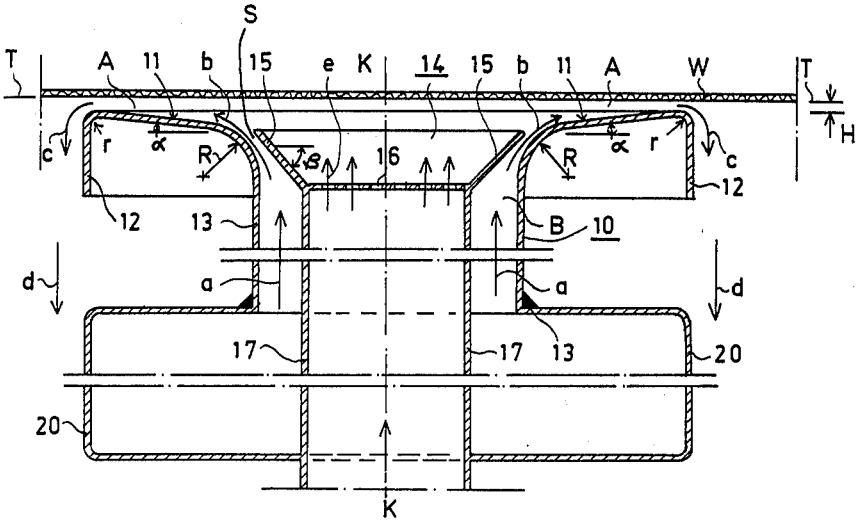
FIG. 1 presents, centrally sectioned, a circularly symmetric nozzle according to the invention.

The nozzle member 10 in FIG. 1, which is circularly symmetric with reference to its central axis K-K, has a substantially disk-shaped annular carrying surface 11 having on its outer rim a downwardly extending edge or skirt 12. In the centre of the carrying area A defined by the component 11 there is an aperture B, and the carrying area A adjoins, by mediation of an annular outer guide surface with radius of curvature R, the gas supply tube 13 of the nozzle member 10. The carrying surface 11 of the nozzle member 10 is conical so that its pitch angle $\alpha$ is preferably between 1° and 10°. The radius of curvature R of the inner edge of the saucer-like portion confining the carrying surface is preferably a multiple of the radius of curvature r of its outer rim.

Figure 2:
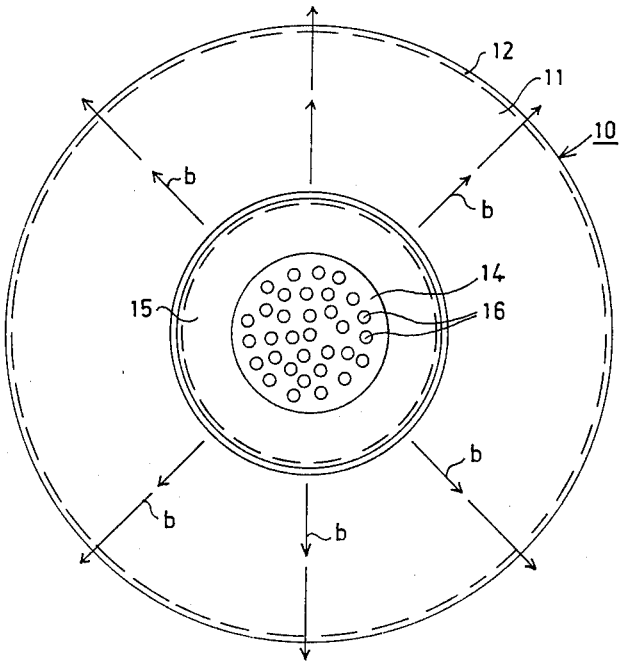
FIG. 2 shows a nozzle, viewed from the side of its carrying surface.

In the centre of the saucer-like outer guide portion, there is an inner member 14 which guides the entering gas flow, this member being, as shown in FIGS. 1 and 2, plate-like and has on its margins upwardly and outwardly extending inner guide wall 15 defining an angle $\beta$ with the horizontal which, for example, is about 45°. The central part of the inner guiding member 14 of FIGS. 1 and 2 has been provided with perforations 16, which communicate with the pipe 17 fitted within the tube 13. The outer surface of inner guide wall 15 and the inner surface of the saucer-like annular outer guide surface define the annular slits.

The operation of the nozzle member 10 is adjustable e.g. by making the guiding member 14 selectively positionable horizontally and/or vertically. It is possible in this manner to influence not only the air quantity but also the shape of the flow field b discharging from the nozzle member 10, so that if need be the flow field may be regulated to have even a configuration differing from circular symmetry.

Figure 3:
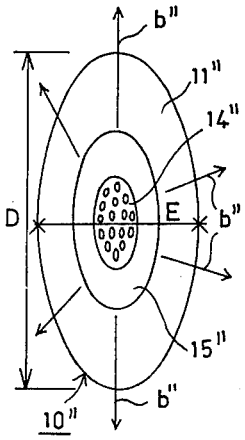
FIG. 3 presents an elliptic variant of the nozzle of the invention, viewed from the side of the carrying surface.

The air nozzle displayed in FIG. 3 differs from that of FIGS. 1 and 2 in that the nozzle presents is not circularly symmetrical with reference to its central axis but, rather is elliptical, whereby the carrying surface 11'' is generally elliptical. Similarly elliptical is the inner guiding member 14'', or at least the flow guiding wall 15'' extending upwardly and outwardly from the guiding member 14''. The elliptic ratio E/D of the dimensions E and D of the component 11'' is selected in accordance with the particular application in mind.

Figure 4:
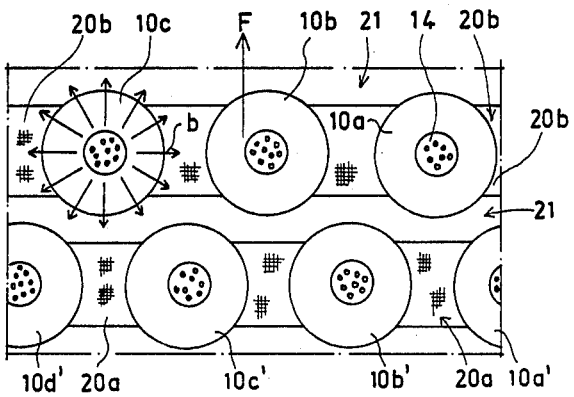
FIG. 4 illustrates an example of a floating dryer carried out with nozzles of the invention, viewed from above its carrying surface.

FIG. 4 illustrates an example of the mutual disposition of the nozzle members 10 of the invention in a floating dryer, where nozzle members 10 have been provided in rows 10*a*, 10*b*, 10*c*; 10*a'*, 10*b'*, 10*c'*; 10*d'* etc. transverse to the direction of travel F of the web W, intercalated so that the triangles defined by the central axes of three adjacent nozzle elements 10 are substantially equilateral.

Figure 5:
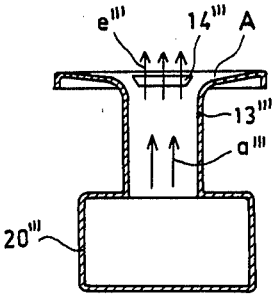
FIG. 5 shows a variant of the nozzle of the invention.

FIG. 5 shows an embodiment of the invention wherein the central air is derived directly from the air flow a''' coming from the flow passage 20''' into the tube 13'''. Adjacent to the carrying area A, there is at the mouth of the tube 13''' a flow guiding member 14''', which is e.g. a saucer-like disk with flow-guiding side walls and having a perforated central portion. Through this perforation the central air, acting as has been described, discharges in the form of a flow field e'''.

Figure 6:
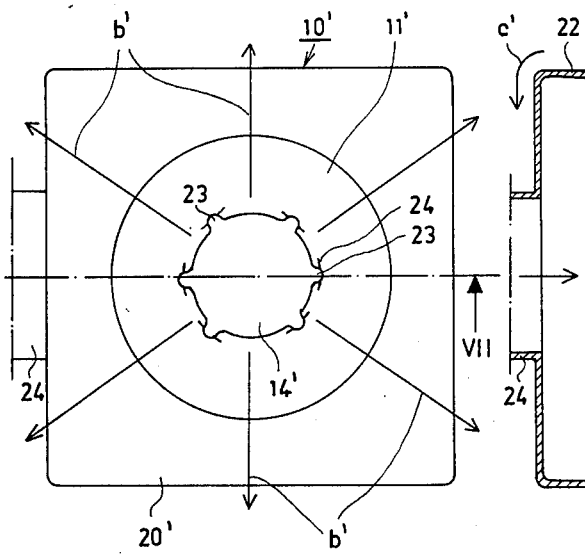
FIG. 6 shows an embodiment of the invention wherein the carrying surface of the nozzle is formed, without intermediate tubes, from the specially shaped cover of the air distributing component.
Figure 7:
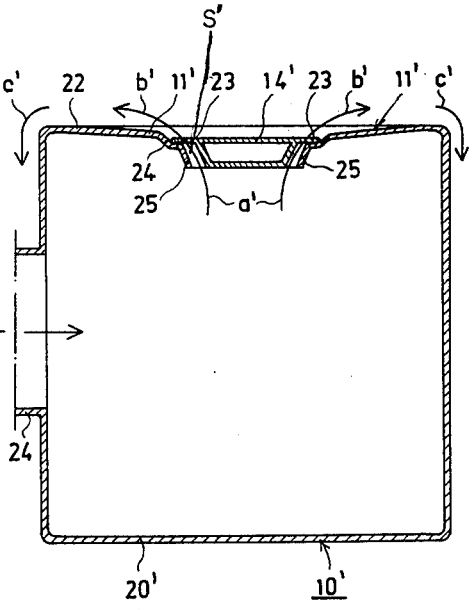
FIG. 7 shows the section along line VII—VII in FIG. 6.

As shown in FIGS. 6 and 7, the nozzle member 10' comprises a box-like flow distributing member 20', into which the carrying gas is introduced by the pipe 24. One wall 22 of the box-like component 20' has been shaped to present a frusto-conical carrying surface 11', on one margin of which, according to the invention, the annular nozzle slit s' opens. From within the box-like part 20' discharges, through the said annular nozzle slit s' and into contiguity with the carrying surface 11', a radial flow b', which turns as flow c' into the nozzle interstices. The annular nozzle slit is defined on the outside by a guiding component 25 integral with the cover 22, and on the inside by the flow guiding member 14', which is solid in this embodiment, which means that no central air is used. The saucer-like flow guiding member 14' has on its outer periphery, preferably spaced at 60° intervals, symmetrically placed projections 23, by the aid of which the guiding member 14' is held in the centre of the carrying surface 11. Consistent with the projections 23, there are grooves 24 in the flow guiding component 25, in which the guiding member 14' is secured. It is possible with the aid of the projections 23 to direct the flow field b' and to divide it, for instance so that the projections 23 on adjacent nozzle members are placed to point towards each other so that any directly opposed flows between adjacent nozzle members will be eliminated. In modification of the embodiment of the invention shown in FIGS. 6 and 7, one may in the rectangular cross section passage corresponding to component 20' provide a plurality of nozzle slits and carrying surfaces after each other and/or side by side.

The nozzle members of the invention presented in the figures operate as follows. The drying gas stream is introduced into the nozzle members 10 through the entry passage (not depicted) into the distributor headers 20*a*, 20*b* etc., whence the drying gas flow divided into the tubes 13 of the nozzle members 10 and thereby as flow a further to become a radial flow b in contiguity with the carrying surface 11 substantially parallel to the web. This flow b causes between the carrying surface 11 and the web W a supporting effect based on its state of motion. The radially spreading flow field b turns after the edge 12 of the nozzle member, downward to become the flow c, and through the interstices 21 of the distributor headers 20*a*, 20*b* the gases pass to an exit duct (not depicted). The radial flow b becomes adherent to the carrying surface or to the web by the aid of the Coanda phenomenon.

In another embodiment of the invention, the following gases are also brought into contiguity with the web W through the flow guiding member 14. In FIGS. 1 and 2 this is accomplished in that through the tube 17 from the flow f central air is directed by the flow field e against the web W, this central air being injected into the flow field b, causing the effects already described. As shown in FIG. 5, the central air is taken from the flow a''' through the guiding member 14''' as flow field e'''.

In an advantageous embodiment of the invention, the angle $\alpha$ of the annular part confining the carrying surface is selected so that in the area A of the cross section of the radial flow b will be substantially constant at various points along the carrying surface 11.

I claim:

1. A nozzle for use in connection with web treatment apparatus whereby a gaseous medium is directed into contiguity with the web and wherein the web is supported without contact for treatment, comprising: a carrying surface extending substantially parallel to the web; guide members defining an annular slit located in a central region of said carrying surface so that said carrying surface surrounds said annular slit, said guide members being formed such that gaseous medium flowing therethrough will flow in substantial contiguity with said carrying surface in a substantially radial flow field relative to said annular slit and in a direction substantially parallel to the web; and means for directing the flow of gaseous medium into the nozzle, whereby the gaseous medium exits from said annular nozzle slit and flows in substantially contiguity with said carrying surface in a substantially radial flow field relative to said annular slit and in a direction substantially parallel to the web.

2. The combination of claim 1 wherein said flow guide members and carrying surface are substantially circularly symmetric with respect to the central axis of said nozzle.

3. The combination of claim 1 wherein said guide members include an inner flow guide member having a guide surface situated in a central region defined by said carrying surface, said inner flow guide surface directing the gaseous medium into the radial flow field.

4. The combination of claim 3 wherein said inner flow guide member further comprises a tubular portion opening into said central region defined by said carrying surface, said tubular portion comprising means for directing a central flow of gaseous medium, which is surrounded by the radial flow field, against the web.

5. The combination of claim 4 further comprising means for directing a flow of gaseous medium into said tubular portion to comprise the central flow, said means being independent of said means for directing the gaseous flow medium into the nozzle.

6. The combination of claim 4 wherein said means for directing the gaseous flow medium into the nozzle further directs a flow of gaseous medium into said tubular portion to comprise the central flow.

7. The combination of claim 1 wherein said flow guide members and carrying surface are substantially elliptical with respect to the central axis of the nozzle.

8. The combination of claim 1 wherein said carrying surface comprises a portion of a wall of an air-distributing conduit.

9. The combination of claim 1 wherein said flow guide members defining said annular slit include an outer guide member defining a central opening and an inner guide member situated within said central opening and wherein said inner guide member includes a plurality of outwardly extending projections spaced along its periphery for locating said inner guide member with respect to said outer guide member.

10. The combination of claim 9 wherein said projections bridge said annular slit whereby the flow field emanating from said annular slit can be adjusted so that gaseous medium emanating from mutually adjacent nozzles will not be directed against each other.

* * * * *